United States Patent [19]

Fuchs

[11] Patent Number: 4,669,806

[45] Date of Patent: Jun. 2, 1987

[54] TERMINAL STRIP CONNECTOR BLOCK

[75] Inventor: Helmut Fuchs, Halver, Fed. Rep. of Germany

[73] Assignee: Karl Lumberg GmbH & Co., Schalksmuhle, Fed. Rep. of Germany

[21] Appl. No.: 726,595

[22] Filed: Apr. 23, 1985

[30] Foreign Application Priority Data

May 9, 1984 [DE] Fed. Rep. of Germany ..... 3417010

[51] Int. Cl.[4] ..... H01R 9/24

[52] U.S. Cl. ..... 439/712; 439/746; 439/813

[58] Field of Search ..... 339/198 R, 198 G, 198 GA, 339/198 H, 198 S, 270 R, 272 R, 272 A, 220 R, 217 PS, 217 S, 17 R, 17 N

[56] References Cited

U.S. PATENT DOCUMENTS

| | | | |
|---|---|---|---|
| 3,340,497 | 9/1967 | Balint | 339/217 S |
| 4,006,323 | 2/1977 | Nelson et al. | 339/272 A |
| 4,239,324 | 12/1980 | Stenz | 339/198 H |

FOREIGN PATENT DOCUMENTS

| | | | |
|---|---|---|---|
| 1015890 | 9/1957 | Fed. Rep. of Germany . | |
| 2514206 | 7/1976 | Fed. Rep. of Germany | 339/272 A |
| 2511385 | 3/1978 | Fed. Rep. of Germany . | |
| 2642262 | 3/1980 | Fed. Rep. of Germany . | |
| 2911972 | 10/1980 | Fed. Rep. of Germany . | |
| 2258716 | 8/1975 | France . | |

*Primary Examiner*—Gil Weidenfeld
*Assistant Examiner*—Thomas M. Kline
*Attorney, Agent, or Firm*—Karl F. Ross; Herbert Dubno; Ronald Lianides

[57] ABSTRACT

An electrical terminal strip comprises an insulating body having a plurality of connector compartments, a corresponding number of clamp members constructed as compartment liners each having a clamp passage in which an electrical conductor is insertable and a threaded hole for receiving a clamp screw. Each of the clamp members is provided with a clamp bracket having both a conductor engaging element and at least one solder connector pin. The clamp member is insertable through its solder connector end into the connector compartments of the insulating body where it is held undetachably, while the clamp bracket is subsequently inserted through a lateral opening in the insulating body in a direction opposite to the direction the conductor is inserted so that the conductor engaging element is in the clamp space. No other components or assembly steps are required to unite the conductor clamp member and clamp bracket in the insulating body, but a base plate may or may not be a part of the electrical strip. When a base plate is employed however, it can advantageously interlock with the clamp bracket so as to be held in place and to assist in keeping the clamp bracket in position.

7 Claims, 7 Drawing Figures

TERMINAL STRIP CONNECTOR BLOCK

FIELD OF THE INVENTION

My present invention relates to electrical connector units, i.e. terminal strips or blocks and, more particularly, to improved electrical connectors or terminal strips having fewer component parts and requiring fewer assembly steps.

BACKGROUND OF THE INVENTION

Electrical connector blocks of the prior art to which my invention relates generally comprise an insulating body having a plurality of connector sockets, recesses or receptacles in conformity with the number of electrical connections to be made, a corresponding number of clamp members constructed advantageously as traction or draw sleeves having a clamp passage in which an electrical conductor is inserted and a threaded hole for receiving a clamp screw, each one of the clamp members being provided with a conductor protective element inside of the clamp passage, and at least one solder connector pin or lug.

The conductor protective element and the solder connector pin can be constructed in one piece as a bent or saddle-shaped member and the clamp member inserted into the connector socket from the solder connector end can be firmly held undetachably (i.e. so as not to be lost therefrom) in the insulating body whereby the bent member is anchored at least indirectly on or in the insulating body.

With this kind of electrical terminal strip conductor connections are made particularly to printed circuits. They have according to requirements a fixed number of contacts and are normally multipoled, for example with two, three, four, six, eight, twelve or eighteen clamp members. The insulating body then has a corresponding length.

For this kind of prior art electrical terminal strip, for example, according to German Pat. No. 25 11 385 it is characteristic that the connector sockets are closed in the lengthwise direction along the insulating body parallel to the row of connector sockets except for the conductor insertion openings and the clamp member with the clamp bracket (formed with the contact member between the conductor and screw and with the solder pin) inserted is put in from the base or through the solder connector end.

For holding the clamp body or clamp bracket in the connector socket two variations are known. In one according to the teachings of German Pat. No. 25 11 385, to firmly anchor each individual part undetachably in the insulating body housing, the clamp bracket is engaged with a form-fitting insulating body, and a spring projection or the like is constructed in the clamp bracket, which engages in a projection recess in the insulating body. Here also a direct anchoring of the clamp bracket in the insulating body results. In this kind of terminal strip no base plate is necessary.

This is however not always desirable, and thus there is another structural form, in which a substantially flat base plate is installed in a peripheral edge about the solder connector end of the insulating body. The base plate has passages through which the solder connector pin is threaded.

In this case the undetachable arrangement of the clamp member and the clamp bracket in the insulating body is caused by the base plate. Here too the clamp bracket is directly anchored in the insulating body. The correct attachment results from putting in the base plate in the terminal strip in the same way as described in German Pat. No. 25 11 385 from the solder connector end of the open insulating body.

In both known electrical terminal strips in order to provide for attachment in the insulating body with the contact elements a simply manually operable component or part is assembled. with the clamp and the clamp bracket in a separate work operation These mounting structural components or parts are brought to the insulating body and placed in it.

OBJECTS OF THE INVENTION

Thr principal object of my invention is to provide an electrical terminal strip as described in which this additional mounting step is not required.

It is an object of my invention to provide an improved electrical terminal strip which overcomes disadvantages of the prior art.

It is also an object of my invention to provide an improved electrical terminal strip which is of a simpler structure having fewer parts and which requires correspondingly fewer assembly steps.

It is a further object of my invention to provide a safe, improved electrical terminal strip in which an additional structural component previously required to mount the clamp member and the clamp bracket in the insulating body with the electrical conductors can be omitted.

SUMMARY OF THE INVENTION

These objects and others which will become apparent hereinafter are attained in accordance with my invention in an electrical terminal strip comprising an insulating body having a plurality of connector compartments in conformity with the number of electrical contacts to be made, and a corresponding number of clamp members constructed advantageously as traction or draw sleeves each having a clamp passage in which a respective electrical conductor is insertable and a threaded hole for receiving a respective clamp screw.

Each clamp member is provided with a conductor protective element received within its passage and at least one solder connector pin, the conductor protective element and the solder connector pin being constructed in one piece as a clamp bracket and the clamp member introduced into the connector compartments through its solder connection end is held undetachably in the insulating body, in which the clamp bracket is anchored at least indirectly on or in the clamp member.

According to the invention the conductor protective element of the clamp bracket is insertable through a first lateral opening in the insulating body in a direction opposite to the direction the electrical conductor is inserted so that the conductor protective element is located in the clamp space or compartment.

According to the invention therefore the clamp bracket is introduced after the clamp member and of course accordingly attached with its clamp member brought to its active position in the insulating body; that is, with its conductor protective element absent from the clamp space of the clamp member in the insulating body. The introduction of both pieces occurs in different directions which are transverse to one another.

Complete installation in the insulating body is possible without requiring any manual or mechanical mounting stations. The mounting happens, for example, so that the clamp members are put in the connector compartments of the insulating body held upwardly by their solder connector ends, whereupon the clamp bracket is inserted from the side. It is also possible in a reasonable way to work with the clamp brackets fastened together with a belt.

It is of course basically not new to insert contacting pieces transverse to the conductor insertion direction in the insulating body. This has been previously taught, for example, in German Patent document No. DE-AS 10 15 890. This disclosure relates, however, not to a terminal strip, but to a sequential set of terminals, comprising a plurality of single pole modules which are plugged together in a layered structure. Therefore a number of modules corresponding to the required pole count are pushed onto a common supporting rail, and the closed side wall of the neighboring module closes the open side of the foregoing, in which the contact pieces are put in transverse to the direction of insertion of the conductor. As in the prior art already explained, these parts are bound together with each other. German Patent document No. DE-AS 10 15 890 differs from the other prior art, for example from German Pat. No. 25 11 385 in principle only by the contact pieces being mounted in the other attachment direction.

New and correspondingly advantageous to the invention are the different insertion directions of the clamp member and the clamp bracket and the fact, that these parts are introduced separately and successively into the insulating body.

There are various possible structure for electrical terminal strips according to the described basic principles of my invention.

In a specific embodiment which has been found to be particularly advantageous, the side wall of the insulating body opposite to the conductor insertion opening has a plurality of lateral first openings and solder connector pin openings (second openings) extending in the direction of the solder connector pins from the first openings, the first or upper openings having a height and width substantially larger than the corresponding height and width of the free arm of the conductor protective element and each of the second or lower openings is positioned at the solder connector end of the insulating body for insertion of the solder connector pin. Further each of the clamp brackets may be supported by at least one barblike projection cut out of it which engages on an inner surface of the insulating body and this projection is on the conductor protective element or a first connecting piece of the clamp bracket parallel to it.

In this refinement the base plate closing the clamp space on the solder connector side of the insulating body can be omitted.

Such a base plate is however desirable in another specific embodiment, in which the clamp member is held immovable in the insulating body only on a supporting surface beneath the clamp screw and a base plate holds it so as to prevent transverse motion. The solder connector pin is engaged in a passage through the base plate; when the base plate is locked on the solder connector pin it is held fitting into the underside edges of the insulating body.

In this embodiment the base plate is held on the insulating body only by the solder connector pins of the clamp brackets and is not firmly attached to the insulating body. Between the base plate and insulating body there is only a form-fitting engagement of the pieces with each other, the shifting of the base plate being thereby prevented in its own plane. In order that a corresponding dislocation of the clamp bracket is prevented, which would involve a shift of the solder connector pin laterally, the base plate is held by the lower supporting surface of the insulating body transverse to the plane of the base plate.

Advantageously in either embodiment the clamp bracket can be shaped like a question mark (?) with the conductor protective element at one end and the solder connector pin at the other end.

BRIEF DESCRIPTION OF THE DRAWING

The above and other objects, features and advantages of my invention will become more readily apparent from the following description, reference being made to the accompanying drawing in which.

SPECIFIC DESCRIPTION

Figure 1:
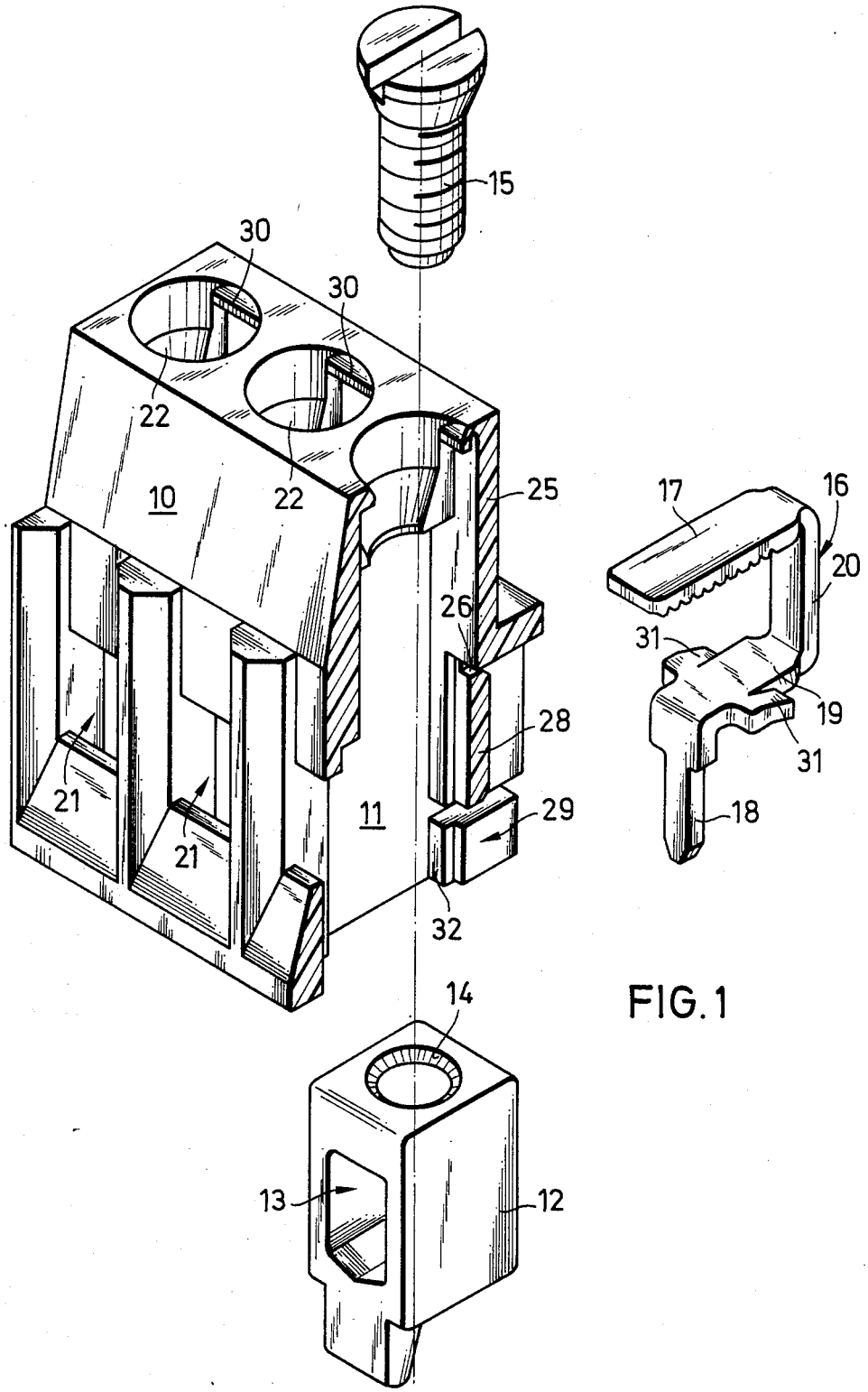
FIG. 1 is an exploded, perspective view of the electrical terminal strip according to a first embodiment of my invention.

The drawing shows an actual electrical terminal strip with a magnified scale of approximately 8:1. This kind of connector usually has an insulating body with a maximum width of about 10 mm and contact or pin spacing of 5 mm.

Each electrical terminal strip comprises an insulating body 10 with several connecting compartments 11, a clamp member 12 associated with each of the connector compartments 11, having a clamp passage 13 into which an electric conductor can be inserted and also having a top threaded hole 14 for receiving a clamp screw 15, and finally a clamp bracket 16, which unites in a single structural form or stirrup-shaped member a conductor protective element 17 and a solder connector pin 18.

In each specific embodiment shown in the drawing the clamp bracket 16 is approximately in the shape of a question mark, whose free extreme ends are formed by the conductor protective element 17 at one end and the solder connector pin 18 at the other end. These two components lie perpendicular to each other.

Extending from solder connector pin 18 is a first connecting piece 19 immediately following it and bent away from it at approximately a right angle so as to extend parallel to conductor protective element 17.

Following the first connecting piece 19 bent back approximately 90° in the reverse direction so as to run parallel to solder connector pin 18 is a second connecting piece 20.

The insulating body 10 comprising a plastic material has a plurality of connector compartments 11, clamp members 12, clamp screws 15, and clamp brackets 16 corresponding to the mumber of terminals, and a corresponding plurality of conductor openings 21 provided in a housing side of insulating body 10, and a plurality of top holes 22 for insertion of clamp screws 15.

Figure 4:
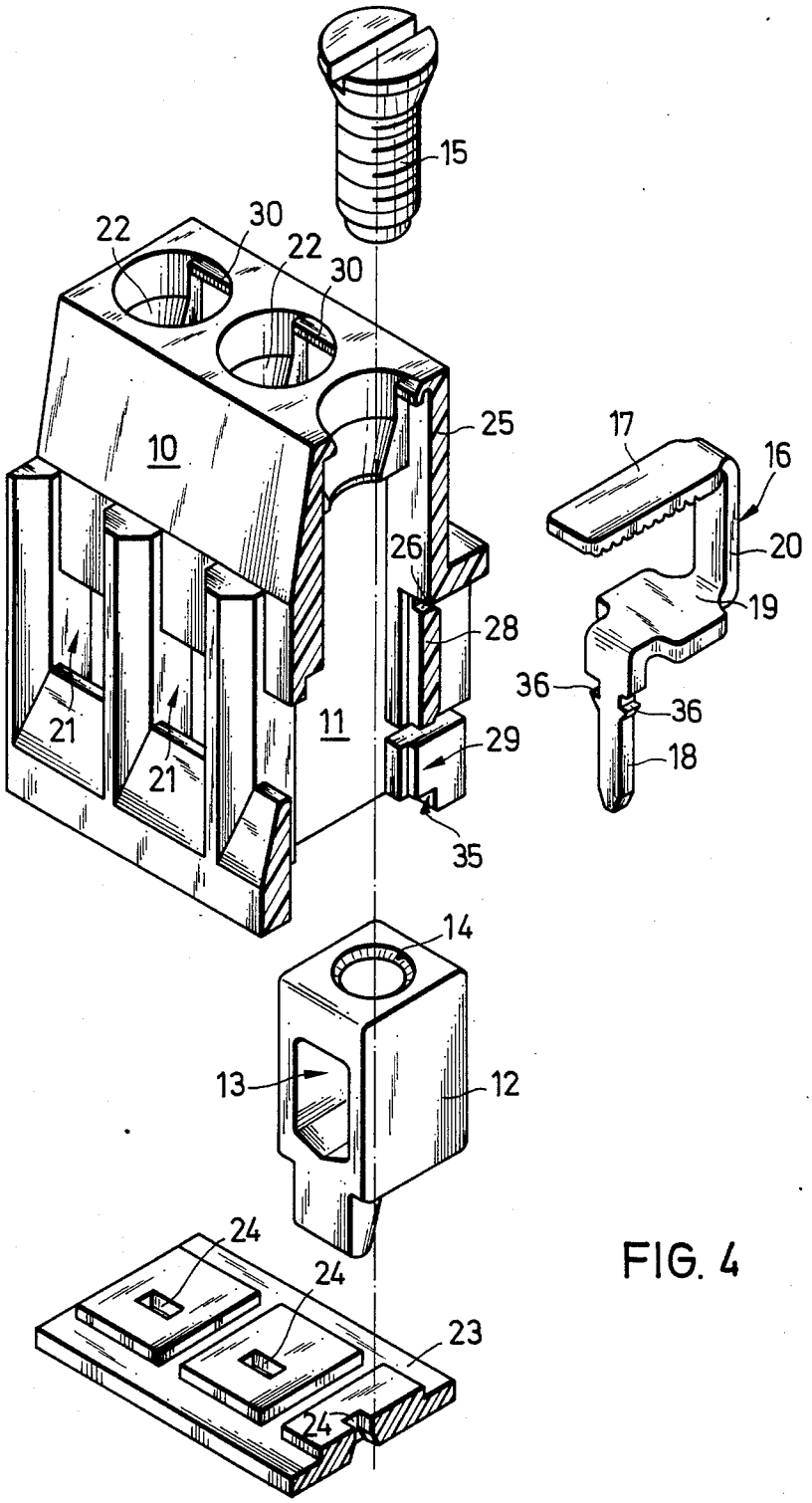
FIG. 4 is an exploded, perspective view of an electrical terminal strip according to a second embodiment of my invention.
Figure 6:
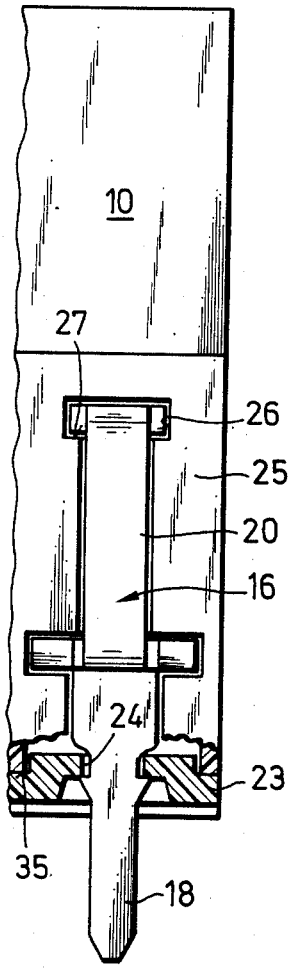
FIG. 6 is a side view in the direction of arrow VI shown in FIG. 5.
Figure 5:
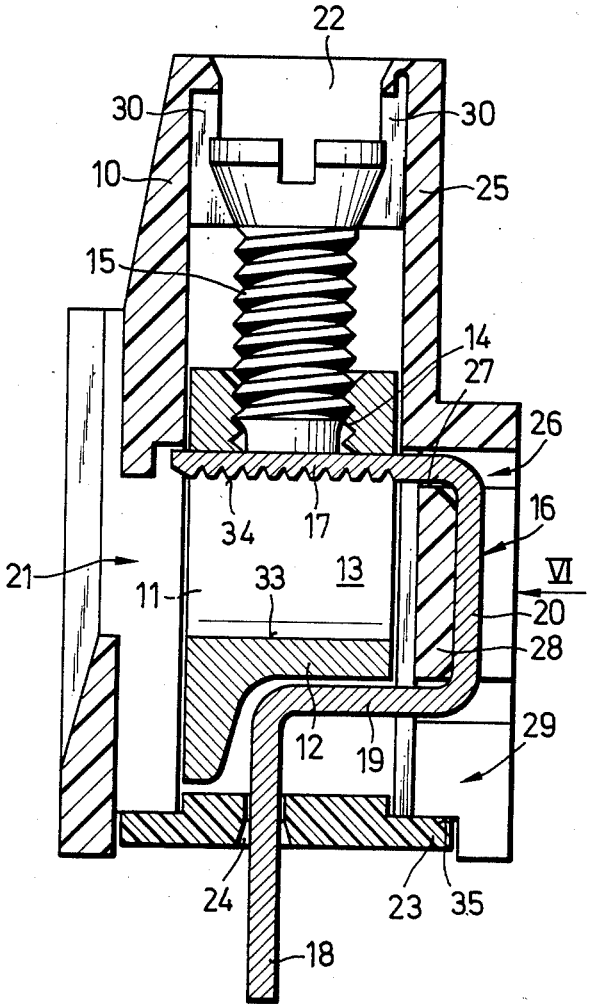
FIG. 5 is a cross sectional view through the electrical terminal strip according to FIG. 4.

The structure according to FIGS. 4 to 6 has additionally a base plate 23 with a plurality of passages 24 corresponding to the position and number of solder connector pins 18 of the clamp bracket 16, the cross section of the passengers 24 fitting the free ends of the solder connector pins 18.

The side wall 25 of the insulating body 10 opposite to the conductor insertion openings 21 has a substantially slot shaped lateral conductor protective element (upper or first) opening 26 in the vicinity of each connector compartment 11, the width and height of the lateral opening 26 being slightly greater than the width and height of the cross section of the conductor protective element 17, in order to provide a necessary play.

Figure 3:
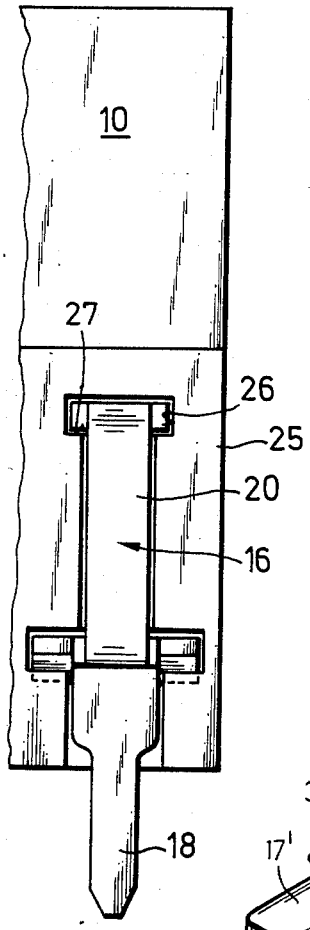
FIG. 3 is a side view in the direction of arrow III in FIG. 2 of the terminal according to FIG. 1.
Figure 2:
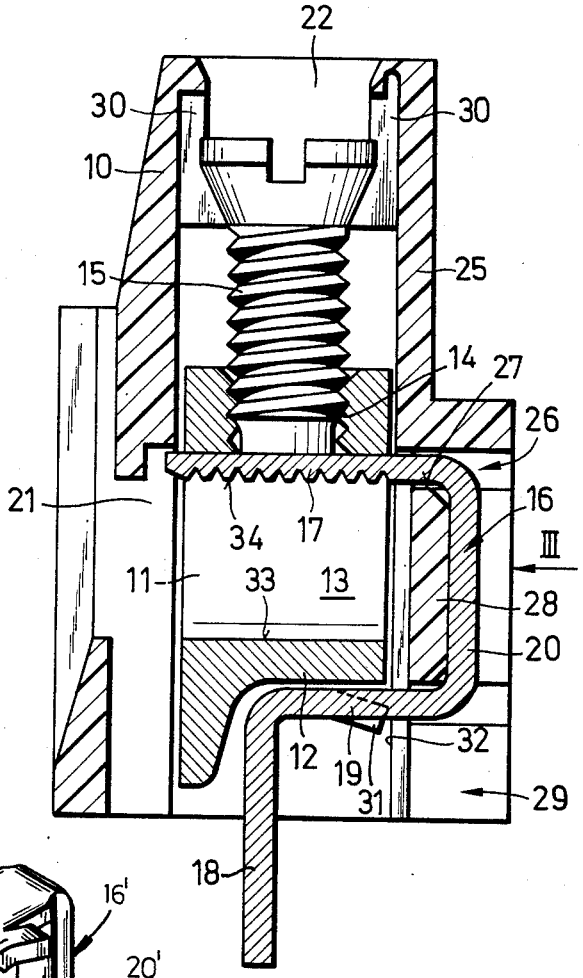
FIG. 2 is a cross sectional view through the electrical terminal strip according to FIG. 1.

The passage surface 27 bounding the underside of the lateral opening 26 serves as a supporting surface for the conductor protective element 17 (see FIGS. 2 and 3 as well as 5 and 6). The wall piece 28 is cut out to form lower opening 29 adjacent the installed position of the solder connector pin 18.

In the mounting of the electrical terminal strip the individual clamp members 12 are guided into the connector compartments 11 from the solder connector end of the terminal strip, which can happen with the insulating body 10 lying stationary on its side or on its head. Directly thereupon or later the clamp screws 15 can—which are held undetachably with the aid of retaining projections 30 in insulating body 10 in their end mounted positions—as shown in FIGS. 2 and 5, be rotated into the threads of the threaded hole 14 for attachment with the clamp member 12. In the electrical connector partially assembled the corresponding plurality of the clamp brackets 16, particularly in the form of a belt, are inserted transverse to the insertion direction of the clamp members 12. The conductor protective elements 17 (in their lengthwise directions) are inserted through the wall opening 26 and into the clamp passage 13 belonging to clamp member 12.

While the clamp members 12 are already held undetachably by the clamp screws 15 in their connector compartments 11, the clamp bracket 16 has springlike lock plates 31 for anchoring it in insulating body 10. The lock plates are found on the first connecting piece 19 running parallel to the conductor protective element 17 and lock underneath connecting piece 19 on the inner wall 32 of insulating body 10. The electrical contacting elements can be held now totally undetachable in insulating body 10. On operation of the clamp screw 15, the clamp member 12 is drawn upward ("elevator clamp") and clamps an unshown conductor between the upwardly directed inner surfaces 33 of its clamp passage 13 and the downwardly directed serrated undersurface 34 of the conductor protective elements 17.

Figure 1A:
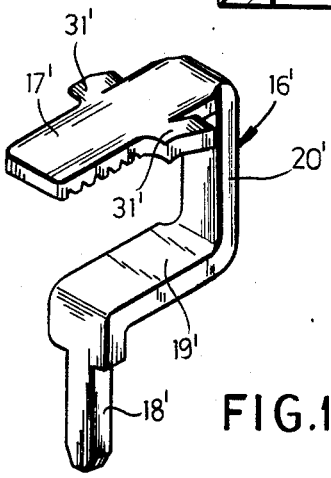
FIG. 1A is a perspective view of an alternative configuration of the bracket.

As can be seen from FIG. 1A, the tongues 31' can be provided upon the upper member 17' while the connecting piece 20', the cross member 19' and the solder pin 18' do not have such formations. The resulting bracket 16' can be inserted in the same way, the upper openings 26 being appropriately dimensioned.

In the second specific embodiment according to FIGS. 4 to 6 the tongues 31 for holding the clamp brackets 16 are eliminated. These are held in the axial direction of the clamp screw 15 or the solder connector pin 18 by the support of the conductor protective element 17 on the supporting surface 27. In the transverse direction, thus in the conductor insertion direction, this occurs with the aid of base plate 23, which is placed loosely with its edges in a ledge 35 in the free underside of the insulating body 10 and the clamp bracket 16 is held in a locking bond by the solder connector pin 18. For this purpose the small outwardly directed wings or plates 36 are provided on solder connector pin 18, by which the passage 24 through the base plate 23 is locked to the solder connector pin 18.

Since the clamp bracket 16 is not shiftable in the axial direction of its solder connector pin 18, in this direction the base plate 23 is held in place. Its transverse motion is prevented by its engagement on the ledge 35 of the insulating body 10 and by that also a transverse motion of the clamp bracket 16 is prevented.

I claim:

1. An electrical terminal strip, comprising:

an elongated insulating body formed with a row of spaced apart connector compartments each having a conductor-insertion opening in one side of said body, a clamp-insertion opening in another side of said body, and a bracket-insertion opening in a side of said body and forming a slot generally orthogonal to that formed with said clamp-insertion opening;

a respective clamp insertable in a given direction into each of said connector compartments through the respective clamp-insertion opening and provided with a clamp passage generally transverse to said direction registering with both said conductor-insertion opening and said slot of said bracket-insertion opening of the respective compartment;

a respective electrically conductive bracket having an elongate portion insertable through said bracket-insertion opening of the respective compartment transversely to said direction and prevented from withdrawal in said direction by at least one resilient lock plate formed on said bracket and engageable with said body, each bracket having a solder connector pin unitary with the respective elongate portion; and a respective screw passing through a respective screw opening in said body and threaded into each of said clamps for pressing the respective conductor introduced through the respective conductor-insertion opening between the respective elongate portion and the respective clamp.

2. The electrical terminal strip defined in claim 1 wherein said body is formed with said screw opening in a side of said body other than those formed with said conductor-insertion opening, said clamp-insertion opening and said bracket-insertion opening.

3. The electrical terminal strip defined in claim 1 wherein said bracket has a shank extending in said direction and lying externally of said compartment and generally orthogonal to said elongate portion.

4. The electrical terminal strip defined in claim 3 wherein said bracket is further formed with an inwardly extending portion on an end of said shank opposite that at which said elongate portion is connected thereto, said inwardly extending portion projecting into said compartment below said clamp, said connector pin being bent at a right angle from said inwardly extending portion.

5. The electrical terminal strip defined in claim 4 wherein said lock plate is provided on said elongate portion.

6. The electrical terminal strip defined in claim 4 wherein said lock plate is provided on said inwardly extending portion.

7. The electrical terminal strip defined in claim 4 further comprising a base plate fitted to said body along said side formed with said clamp insertion opening, said pins extending through said base plate.

* * * * *